US005868520A

United States Patent [19]

Kulp et al.

[11] Patent Number: 5,868,520

[45] Date of Patent: Feb. 9, 1999

[54] CHANNELIZER BALLASTING SYSTEM USING TIRE SIDEWALLS

[75] Inventors: Brent M. Kulp, San Mateo; Jack H. Kulp, San Juan Capistrano; Samuel J. Bechtle, San Clemente, all of Calif.

[73] Assignee: Traffix Devices, San Clemente, Calif.

[21] Appl. No.: 760,633

[22] Filed: Dec. 4, 1996

Related U.S. Application Data

[60] Provisional application No. 60/010,533 Jan. 24, 1996.

[51] Int. Cl.[6] ..... E01F 13/00; E01F 15/00; E01F 9/00

[52] U.S. Cl. ..... 404/6; 404/9

[58] Field of Search ..... 116/63 P; 256/1, 256/13.1; 404/6, 9

[56] References Cited

U.S. PATENT DOCUMENTS

| | | | |
|---|---|---|---|
| 2,957,444 | 10/1960 | Boettler . | |
| 3,386,409 | 6/1968 | Dawson . | |
| 3,451,368 | 6/1969 | Keats . | |
| 3,952,690 | 4/1976 | Rizzo et al. . | |
| 4,083,033 | 4/1978 | Kulp et al. . | |
| 4,611,949 | 9/1986 | Schmanski | 404/9 |
| 4,674,431 | 6/1987 | Cory | 116/63 P |
| 4,710,053 | 12/1987 | Kulp et al. | 404/9 |
| 4,973,190 | 11/1990 | Erwin et al. | 404/10 |
| 5,026,204 | 6/1991 | Kulp et al. . | |
| 5,199,813 | 4/1993 | Nagler . | |
| 5,201,599 | 4/1993 | Kulp et al. | 404/6 |
| 5,234,280 | 8/1993 | Cowan . | |
| 5,451,118 | 9/1995 | Wilkins et al. | 404/6 |
| 5,613,798 | 3/1997 | Braverman . | |
| 5,630,675 | 5/1997 | Boeger | 404/6 |

FOREIGN PATENT DOCUMENTS

| | | |
|---|---|---|
| 1184406 | 6/1959 | France . |
| 2615541 | 11/1988 | France . |
| 365567 | 12/1967 | Sweden . |
| 2125863 | 6/1982 | United Kingdom . |
| 2122239 | 1/1984 | United Kingdom . |

OTHER PUBLICATIONS

"Swintex Traffic Management Products" Swintex Limited.
"Plastic Safety Drum maximun visibility, handling convenience and economy" Plastic Safety Systems.
"When You Think Traffic Cones . . . " Work Area Protection Corp.
"Standfix System / Standfix Flat Cone / It Stands To Reason" American Transportation Equipment, Inc.
"le système Monopode" Monopode S.A.

*Primary Examiner*—Tamara L. Graysay
*Assistant Examiner*—Gary S. Hartmann
*Attorney, Agent, or Firm*—Donald E. Stout

[57] ABSTRACT

The disclosed tire-lock channelizer drum can be secured into a stationary sidewall of a worn out steel-belted radial tubeless truck tire. The tire ring formed by the sidewall is annular, with an inner edge and an outer edge. The tire-lock channelizer drum of the present invention can be inserted into and secured around the inner edge of the stationary tire ring, without the user having to lift the heavy tire ring up and over the top of the channelizer drum.

30 Claims, 4 Drawing Sheets

CHANNELIZER BALLASTING SYSTEM USING TIRE SIDEWALLS

This application claims the benefit of U.S. Provisional Application No. 60/010,533, filed on Jan. 24, 1996 and entitled Two-Piece Stabilizing Base for Traffic Channelizer. This application is related to co-pending application Ser. No. 08/662,602, filed on Jun. 13, 1996 and entitled Unitary Stabilizing Base, which is commonly assigned and expressly incorporated herein by reference.

BACKGROUND OF THE INVENTION

1. Field of the Invention

The present invention relates generally to traffic channelizing devices for use in guiding and directing normal vehicle traffic around road and highway construction sites and the like and, more particularly, to ballast devices for such traffic channelizing devices.

2. Description of Related Art

Traffic channelizing devices have been configured of a variety of different shapes and materials. A typical traffic channelizing device may comprise a hollow drum made of a relatively lightweight plastic material, which will not cause damage to a vehicle if the vehicle should accidentally strike the drum. Since these hollow plastic drums are relatively light in weight, a ballast is used with each plastic drum to prevent the drum from being inadvertently blown over or moved about by the wind and/or air blasts produced by passing vehicles.

Although sandbags have been used in the prior art as ballasts, these sandbags have several drawbacks. Many applications require at least two of these sandbags to be placed within, on, or against the base of the plastic drum to hold the drum in place. Each sandbag may weigh between 35 to 50 pounds. The sandbags must first be filled, and then transported and positioned in place within, on, or against the external base or flange of the drum at the job site. This task is labor intensive and significantly adds to the time, labor, and space requirements for setting up the drums. The sandbags are seldom filled to consistent weights, and the amount of sand used for ballasting often will be either insufficient or excessive. Sandbags are also susceptible to breakage and the potential danger of loose sand on the roadway. It has been found that sand on a dry driving pavement reduces the coefficient of friction between a tire and the road surface, which results in increasing emergency deceleration distances.

Sand-filled plastic bases like that disclosed in commonly assigned U.S. Pat. No. 5,026,204 to Kulp et al., as well as sandbags used with plastic bases are also commonly used to ballast channelizer drums. While the sand-filled plastic base is highly suitable for many applications, other uses may require a different ballast weight or a lower cost alternative. Furthermore, the use of sandbags in conjunction with plastic bases presents the same difficulty as when the sandbags are used directly on or against an external flange or base of the drum.

Some traffic channelizing devices in the form of detachable, two-piece channelizers and traffic cones are well known in the art. These devices store a pre-selected volume and weight of ballast therein. Such a two-piece traffic channelizer permanently stores ballast in the form of a cast iron ring in the base element or, alternatively, the base is configured with an internal, upturned flange for storing ballast in the form of concrete or a particular material such as sand.

Other ballasting systems have used the side wall of a worn out steel belted radial tubeless truck tire for holding a drum or cone in an upright position. For example, in U.S. Pat. No. 5,234,280 to David A. Cowan, the diameter of the sidewall is large enough to be inserted over the top of the drum, but is small enough to rest around the lower flange portion of the drum. The installation of the sidewall ballast is difficult, because the sidewall must be raised over the top of the drum and then dropped over and around the drum so that the sidewall rests on the bottom large-diameter flange portion of the drum. Because of its weight and bulk, this is an awkward procedure, and often, as the sidewall drops over the drum, portions of its inner diameter contact the reflective sheeting bands adhered to the outer circumference of the drum, and scuff and mark them with black streaks. Over time, this scuffing diminishes the effectiveness of the sheeting, and destroys its appearance. Additionally, channelizing drums of the type employed in such systems typically provide for the mounting of a flashing yellow warning light on the top thereof, in order to ensure additional safety at night or in inclement weather. Such a light must be mounted on the side of the drum closest to the traffic lane, in order to accurately mark the lane and to prevent drum impacts by disoriented drivers. However, the ballasting arrangement disclosed in the aforementioned Cowan patent has been found in practice to be problematic when such lighting is employed, because the passage of large vehicles at relatively high speeds creates an unequal moment arm on the drum, due to the light, which tends to cause the drum to rotate within the ballasting ring. This rotation occurs because the effective diameter of the drum is substantially smaller than that of the ballasting ring, creating a loose fit. Once these drums have rotated over time, to various degrees, the flashing lights, being oriented at differing angles of rotation on each of the drums, no longer effectively mark the traffic lanes, and must be reset to their proper orientation by a work crew.

Thus, none of the prior art external ballasting systems for channelizing drums have implemented a rubber stabilizing base, preferably constructed of a tire sidewall, which can be installed with relative ease, that minimizes damage to the reflective sheeting on the drum and eliminates rotation of the drum when a flashing light is installed, and that can furthermore efficiently and effectively ballast a traffic channelizing device in an upright position in all wind and traffic conditions.

SUMMARY OF THE INVENTION

The tire-lock channelizer drum of the present invention can be secured into a stationary sidewall of a worn out steel-belted radial tubeless truck tire. The ring formed by the sidewall is annular, with an inner edge and an outer edge. In contrast to prior art systems, which require a user to hoist the tire ring up and over the top of the channelizer drum, the tire-lock channelizer drum of the present invention can be inserted into a stationary tire ring, without the user having to lift the heavy tire ring up and over the top of the drum, thereby damaging the fragile reflective sheeting materials on the exterior of the drum.

According to one aspect of the present invention, a traffic channelizing device comprises a base portion which is adapted for insertion into a ballasting device, preferably a tire sidewall ring, which includes a lower insertion end, a tapering-diameter section extending upwardly from the lower insertion end, which increases in diameter with distance from the lower insertion end, an annular rib formed on an upper end of the tapering-diameter section, and a substantially constant-diameter section extending upwardly from the annular rib. Preferably, the diameter of the substantially constant-diameter section is less than the diameter of the annular rib, to thereby snugly accommodate an upper portion of the inner perimeter of a tire sidewall ring, which is angled to have a slightly smaller diameter than a lower portion of the tire sidewall inner perimeter. and a distal end opposite the proximal insertion end. The base portion is preferably integrally molded with the tire-lock channelizer drum to form a unitary drum, though it could also be a separable element, if desired. The tapering diameter section of the base portion of the channelizing device preferably includes a lower portion having a diameter which is equal to or slightly less than a diameter of an inner perimeter of the ballasting device, the inner perimeter forming an opening in the ballasting device for receiving the base portion of the channelizing device. The diameter of the annular rib is preferably slightly greater than a diameter of the opening of the ballasting device, so that both the lower portion of the tapering-diameter section and the annular rib may be inserted through the ballasting device opening.

Additionally, the substantially constant diameter section of the traffic channelizing device is adapted for contacting and fitting snugly with the inner perimeter of the ballasting device, and thereby applying a radially-outwardly directed force onto the perimeter of the ballasting device.

The aforementioned base portion further includes a second annular rib formed at a upper end of the substantially constant diameter section, and includes a second substantially constant diameter section extending upwardly from the second annular rib. A diameter of the substantially constant diameter section is preferably less than a diameter of the second annular rib. The base portion further includes a third annular rib, which is formed at a distal end of the second substantially constant diameter section.

According to another aspect of the present invention, a traffic channelizer device includes an upper end, a lower end adapted for being inserted into and fitting snugly within a perimeter of an opening of a ballasting device, and an intermediate section disposed between the upper end and the lower end. The lower end is adapted for applying a radially-outwardly directed force onto the perimeter of the ballasting device, and the intermediate section has an intermediate-section diameter, which is greater than a diameter of the lower end. The lower end preferably includes both a first annular surface, which has a diameter equal to the intermediate-section diameter, and a second annular surface, disposed above the first annular surface and having a diameter, which is less than the intermediate-section diameter. The intermediate section is preferably adapted for applying an axially-downwardly directed force, in a direction from the upper end to the lower end, onto the perimeter of the ballasting device. The traffic channelizer device may comprise a traffic channelizer drum, the ballasting device may comprise at least one tire ring, the first annular surface may comprise a first annular rib, and the intermediate section may comprise a second annular rib disposed above the first annular rib. The traffic channelizer device may further include a foot ring disposed above the second annular rib, and the at least one tire ring may further comprise two tire rings secured together.

According to still another aspect of the present invention, a base for use with a traffic channelizer device includes an upper section comprising an annular rib, and a lower section having a reduced diameter, relative to a diameter of the annular rib. The lower section is sized and configured to be inserted into a tire ring, and the annular rib is sized and configured to fit snugly within an opening of the tire ring. The diameter of the annular rib tapers into the reduced diameter of the lower section. The upper section further includes a reduced-diameter portion disposed above the annular rib. The diameter of the annular rib tapers into a diameter of the reduced-diameter portion. The base may further include a second annular rib, and a third annular rib disposed above the second annular rib. The third annular rib preferably forms an annular foot step, adapted for receiving a downward force from a users foot, to thereby facilitate insertion of the base into the tire ring.

According to yet another aspect of the invention, a method of inserting a traffic channelizing drum into a ballasting device, preferably a tire ring, is disclosed, which comprises the steps of placing a traffic channelizer drum over a stationary tire ring, aligning a generally circular bottom end of the traffic channelizing drum with a generally circular opening in the tire ring, and inserting the generally circular bottom end of the traffic channelizing drum into the generally circular opening in the tire ring, to thereby snugly fit the generally circular bottom end of the traffic channelizing drum into the generally circular opening of the tire ring.

The present invention, together with additional features and advantages thereof, may best be understood by reference to the following description taken in connection with the accompanying illustrative drawings.

DETAILED DESCRIPTION OF THE PRESENTLY PREFERRED EMBODIMENT

Figure 1:
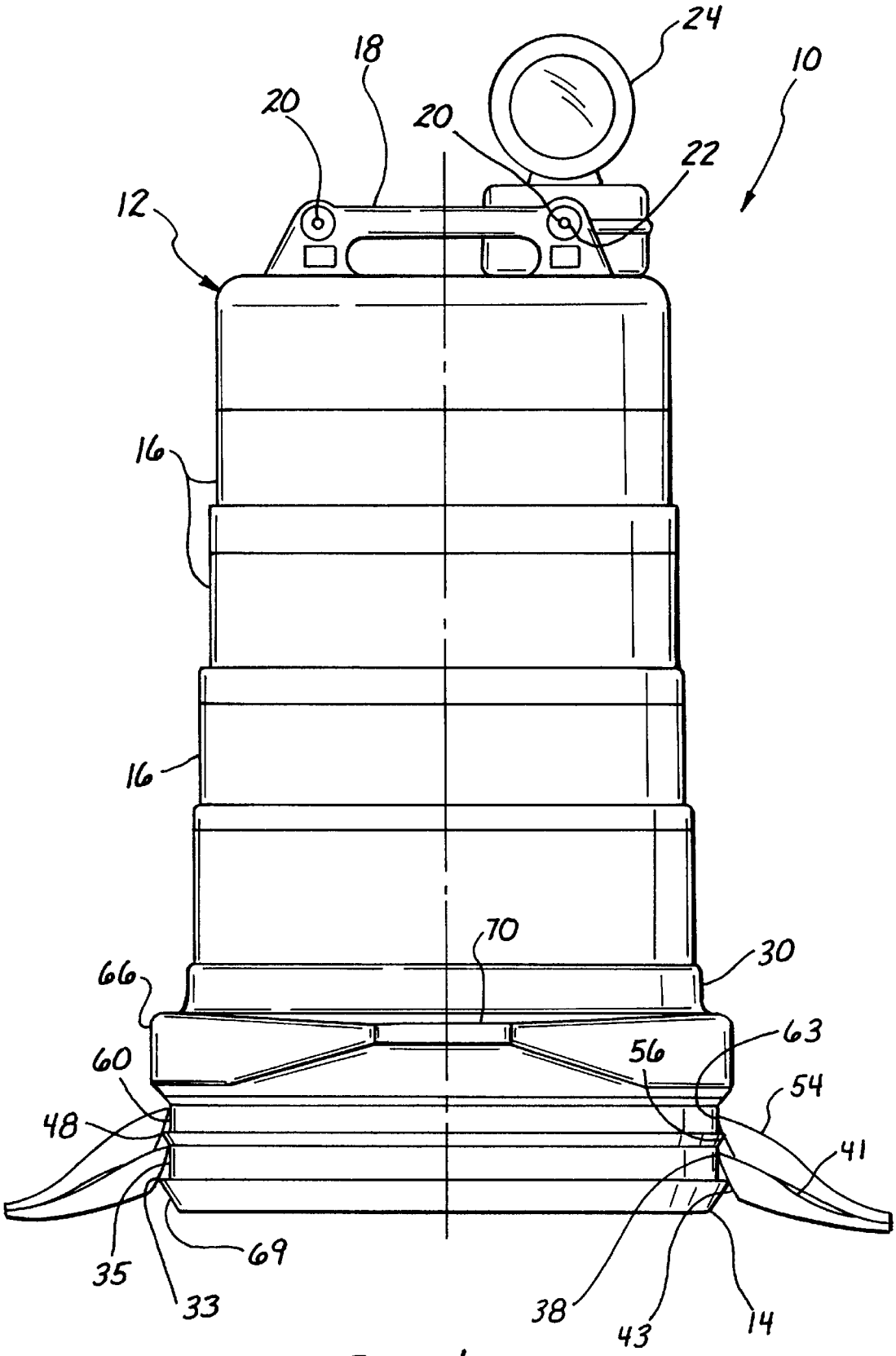
FIG. 1 is a side-elevational view of the tire-lock channelizer drum according to the presently preferred embodiment.

Turning to FIG. 1, a side-elevational view of the tire-lock channelizer drum 10, according to the presently preferred embodiment, is illustrated. The tire-lock channelizer drum 10 comprises an upper end 12 and a lower end 14. The tire-lock channelizer drum 10 preferably comprises a relatively thin-walled, hollow drum that is desirably blow-molded out of a relatively lightweight, deformable plastic material such as a high-density or low-density polyethylene.

The tire-lock channelizer drum 10 is preferably stepped radially inwardly at discrete intervals along the axial length of the tire-lock channelizer drum 10 from the lower end 14 toward the upper end 12. The axially spaced surfaces 16 facilitate stacking of several tire-lock channelizer drums 10 for easy handling and storage, and are preferably slightly recessed, with respect to one another, to protect bands of reflective sheeting applied to one or more of the surfaces 16 against damage during stacking.

Extending axially upwardly from the upper end 12 of the tire-lock channelizer drum 10 is an integrally molded handle 18 for facilitating carrying of the tire-lock channelizer drum 10 from one location to another. Additionally, suitable mounting apertures 20 are placed within the integrally molded handle 18 for attachment of standard warning devices thereto. For example, a fastener 22, such as a bolt, may secure a warning light 24 to the integrally molded handle 18.

The bottom axially spaced surface 30, according to the present invention, comprises a first retaining rib 33, which as presently embodied forms a "snap ring." A first recessed channel 35 is positioned adjacent to and above the first retaining rib 33, and is adapted for contacting an inner perimeter 38 of a first tire ring 41. The first recessed channel 35 applies a radially-outwardly directed force onto the inner perimeter 38 of the first tire ring 41, and the snap ring 33 applies a radially-outwardly and axially-upwardly directed force onto the intermediate surface 43 of the first tire ring 41.

A second retaining rib 48 forms a second snap ring, which is disposed above the first recessed channel 35. The second snap ring 48 is adapted for applying an axially-downwardly directed force onto the inner perimeter 38 of the first tire ring 41. In the presently preferred embodiment, a second tire ring 54 is also used to help secure the tire-lock channelizer drum 10 into the tire rings. Of course, fewer or greater numbers of tire rings may be used, according to design parameters. Greater numbers of tire rings optionally can be used with extra recessed channels and snap rings, to thereby provide greater support to the tire-lock channelizer drum 10. Of course, these greater numbers of tire rings will also provide additional ballast.

The first tire ring 41 and the second tire ring 54 are preferably secured together using bolts, but other securing means, or no securing means, may be used instead. The second snap ring 48 operates on an intermediate surface 56 of the second tire ring 54, similarly to the operation of the first snap ring 33 on the intermediate surface 43 of the first tire ring 41. The second recessed channel 60 operates on the inner perimeter 63 of the second tire ring 54, similarly to the operation of the first recessed channel 35 on the inner perimeter 38 of the first tire ring 41. A lower portion of the annular foot step 66 applies an axially-downwardly directed force onto the inner portion 63 of the second tire ring 54, similarly to the application of an axially-downwardly directed force onto the inner perimeter 38 of the first tire ring 41 by the second snap ring 48.

Both the first snap ring 33 and the second snap ring 48 have gradually tapering bottom sections and quickly tapering top sections. The gradually tapering bottom section of the first snap ring 33 forms a tapered lead-in 69, which facilitates insertion of the tire-lock channelizer drum 10 into both the first tire ring 41 and the second tire ring 54. The tapered lead-in 69 first contacts the inner perimeter 63 of the second tire ring 54, and then guides the inner perimeter 63 of the second tire ring 54 onto the first snap ring 33. The inner perimeter 63 of the second tire ring 54 is then moved onto the first recessed channel 35 while, simultaneously, the inner perimeter 38 of the first tire ring 41 is moved into contact with the tapered lead-in 69. For an alternative embodiment comprising only a single tire ring 54, the insertion process would be complete with the first snap ring 33 and the first recessed channel 35 snugly fitting against the intermediate surface 56 and the inner perimeter 63 of the second tire ring 54. When a second tire ring 41 is also used, for example, the insertion process continues, with the inner perimeter 63 being guided over a gradually-tapering surface of the second snap ring 48 and, subsequently, onto the second recessed channel 60. As the second tire ring 54 is moved over the second snap ring 48 and the second recessed channel 60, the inner perimeter 38 and the intermediate surface 43 of the first tire ring 41 are moved over the tapered lead-in 69, the first snap ring 33, and the first recessed channel 35. The inner perimeter 38 is thus advanced up the tire-lock channelizer drum 10, until the inner perimeter 38 of the first tire ring 41 rests upon the first recessed channel 35 and the inner perimeter 63 of the second tire ring 54 rests upon the second recessed channel 60.

As presently embodied, a diameter of the lower end 14 is slightly less than a diameter of the first recessed channel 35. The diameter of the first recessed channel 35 and the diameter of the second recessed channel 60 are preferably approximately equal. The diameter of the first snap ring 33 is slightly greater than the diameter of the second snap ring 48 because of its lower relative position on the interior circumferential surface of the tire ring (FIG. 1). According to the presently preferred embodiment, the base of the tire-lock channelizer drum 10 is adapted for being secured within a truck tire ring having an inner opening with a nominal diameter of 22.5 inches (the actual measured diameter has been found to average approximately 21.75 inches). The diameter of the lower end 14 is preferably approximately 21.09 inches, the diameters of both the first recessed channel 35 and the second recessed channel 60 are preferably approximately 21.72 inches, and the diameters of the first snap ring 33 and the second snap ring 48 are preferably approximately 22.6 inches and 22.4 inches, respectively. Alternatively, it may in certain instances be desirable to construct a channelizer having smaller diametral dimensions, in order to accommodate its use with automobile tire rings having 14 or 15 inch diameters.

Figure 3:
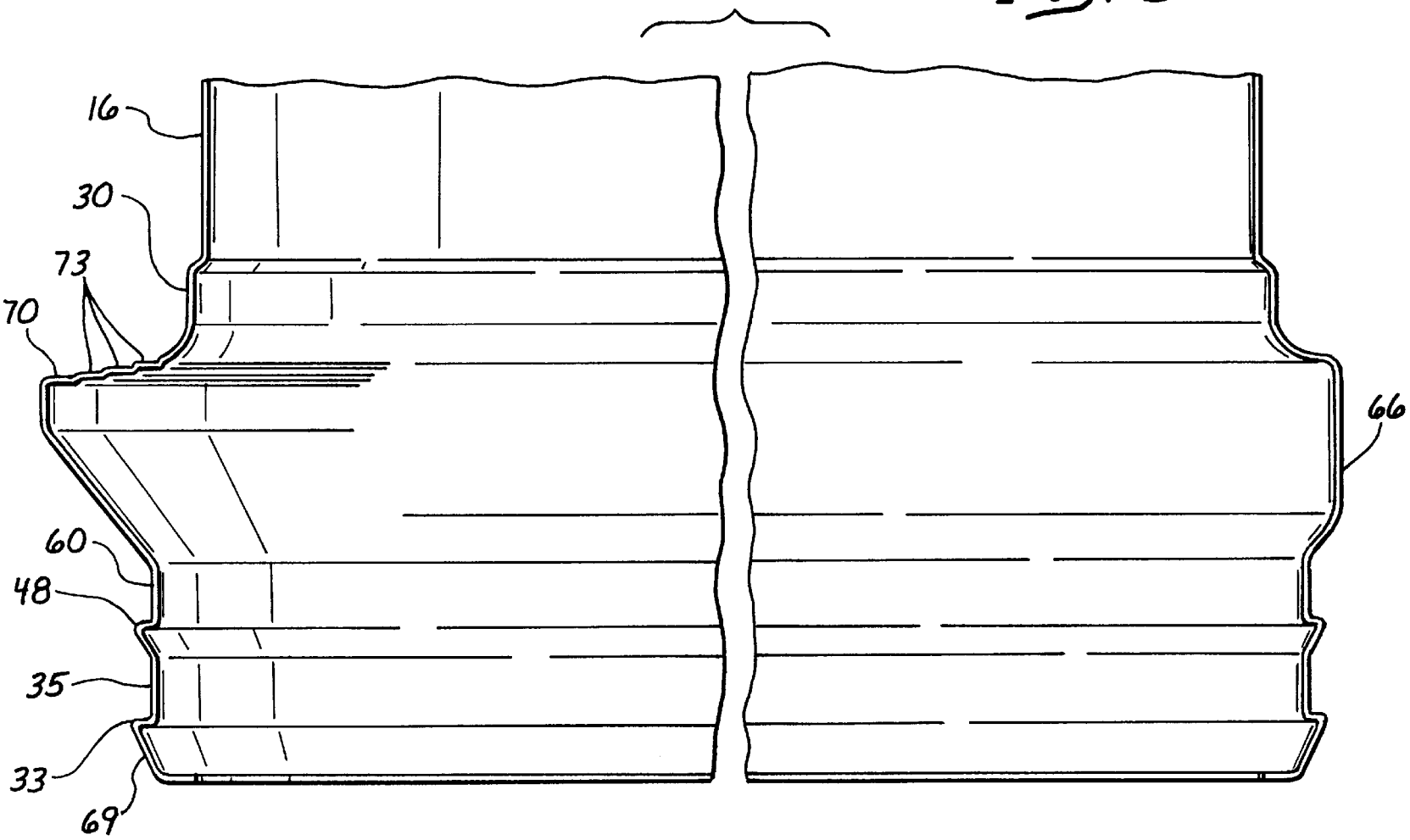
FIG. 3 is a cross-sectional view of the base portion of the tire-lock channelizer drum shown in FIG. 1.

FIG. 3 is a cross-sectional view of the base portion of the tire-lock channelizer drum 10 shown in FIG. 1. The annular foot ring 66 is preferably configured with a relatively large diameter. This relatively large diameter prevents improper operation of the tire-lock channelizer drum 10 by installing the tire rings 41 and 54 over the upper end 12, because the rings would rest upon the annular foot ring 66, and proper ballasting of the tire-lock channelizer drum 10 could not be obtained. Thus, according to the present invention, the tire-lock channelizer drum 10 is designed for insertion into the tire rings, from the lower end 14 of the tire-lock channelizer drum 10. When the tire-lock channelizer drum 10 is properly inserted into the first tire ring 41 and the second tire ring 54, the tire-lock channelizer drum 10 is preferably supported slightly above a support surface, as can be seen in FIG. 1. When struck by a vehicle, the tire-lock channelizer drum 10 preferably deforms and separates from the two tire rings 41 and 54. The tire-lock channelizer drum 10 can subsequently be reformed and reinserted into the tire rings 41 and 54, with substantially no permanent damage. Insertion of the tire-lock channelizer drum 10 into the tire rings 41 and 54 is less strenuous on the user and does not damage the drum's reflective sheeting bands 16, compared to placement of the two tire rings 41 and 54 over the upper end 12 of the tire-lock channelizer drum 10.

Figure 2:
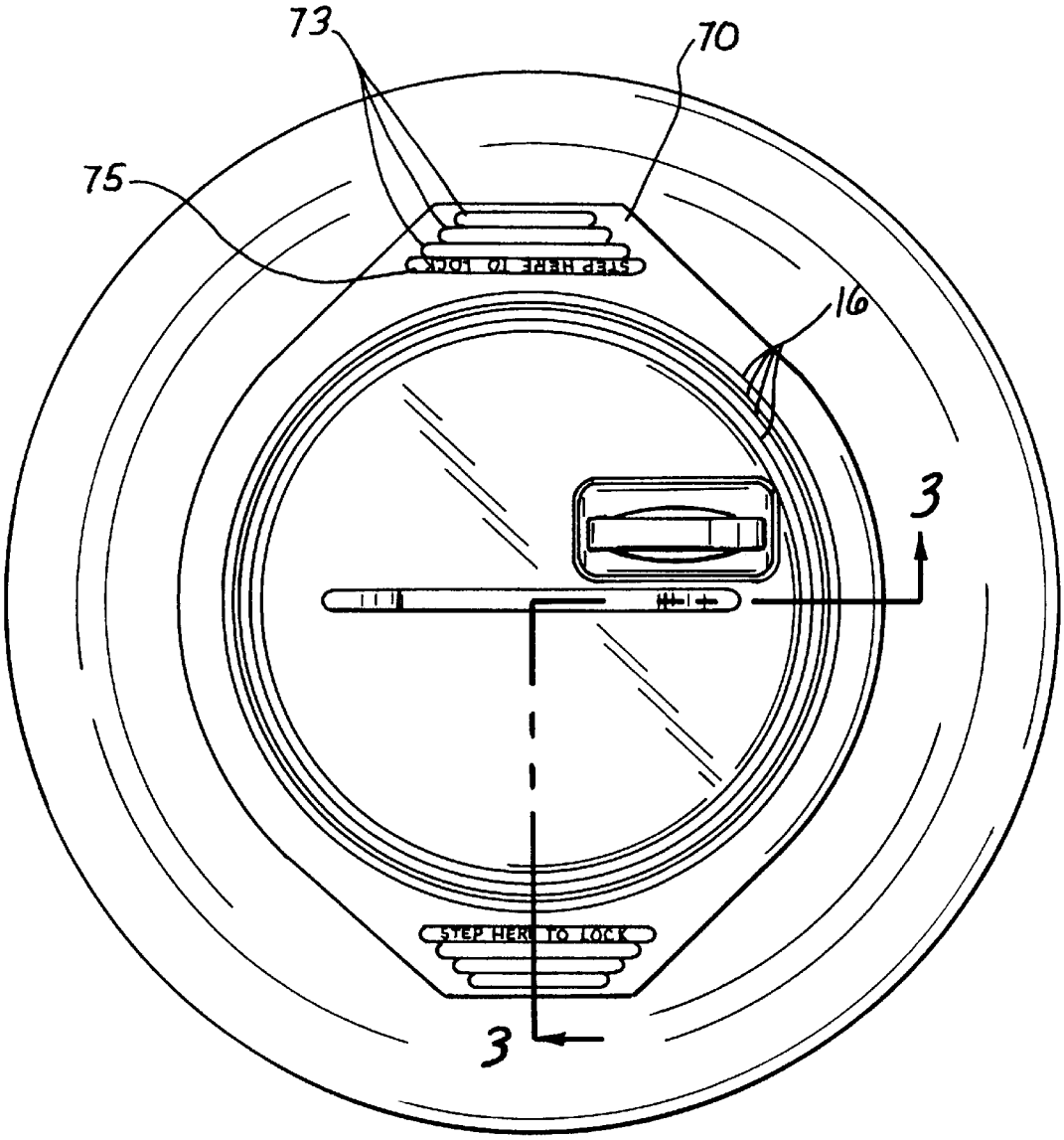
FIG. 2 is a top planar view of the tire-lock channelizer drum of the presently preferred embodiment.

As shown in the top planar view of FIG. 2, the annular foot ring 66 preferably comprises two foot pads 70, which are adapted for receiving downwardly-directed forces from the foot or feet of a user or users, to thereby facilitate insertion of the tire-lock channelizer drum 10 into the tire rings 41 and 54. As presently embodied, each foot pad 70 comprises a plurality of raised surfaces 73. One or more of the raised surfaces 73 may comprise indicia 75 printed thereon.

Figure 4:
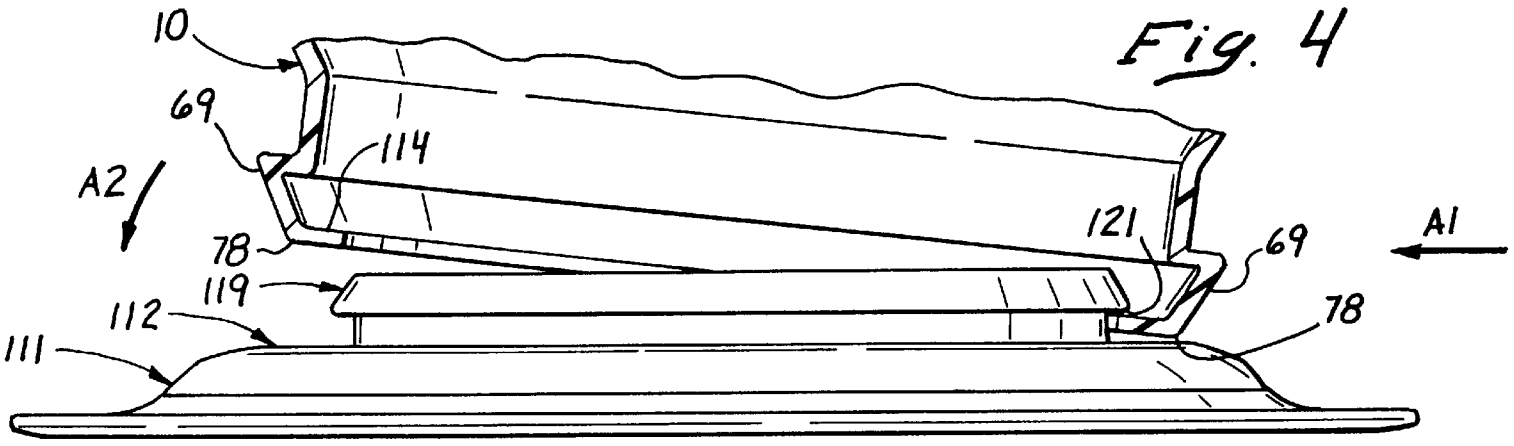
FIG. 4 is a cross-sectional view of the tire-lock channelizer drum being secured to a unitary stabilizing base, according to the presently preferred embodiment.
Figure 5:
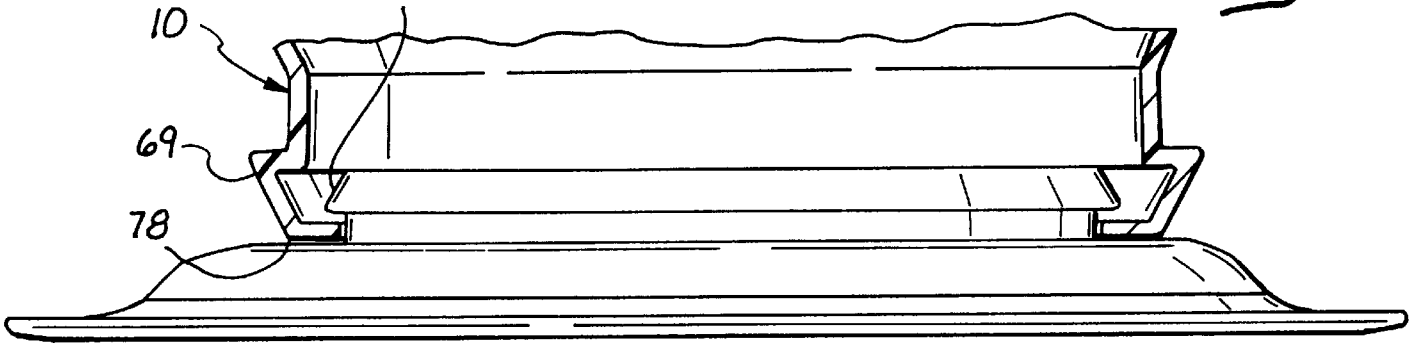
FIG. 5 is a cross-sectional view of the tire-lock channelizer drum secured to a unitary stabilizing base, according to the presently preferred embodiment.

The tire-lock channelizer drum 10 may be secured onto a unitary stabilizing base 111, as shown in FIGS. 4 and 5, or any other similar structure, preferably using a pivoting action. Details regarding the construction of the unitary stabilizing base 111 are disclosed in co-pending and commonly assigned U.S. application Ser. No. 08/662,602, filed Jun. 13, 1996, and entitled Unitary Stabilizing Base, the contents of which are expressly incorporated herein by reference.

The tapered lead-in 69 transitions into a circumferential corner portion 78, which terminates in a circumferential locking lip 114. In order to detachably secure the tire-lock channelizer drum 10 to the unitary stabilizing base 111, a portion of the circumferential comer portion 78 is placed onto the top surface of the unitary piece 112. The entire tire-lock channelizer drum 10 is then moved in the direction of the arrow A1 to thereby move the circumferential locking lip 114 beneath the locking lip 119 of the unitary stabilizing base 111. A portion of the locking lip 119 should preferably contact the inner surface 121 of the locking lip 114, when the tire-lock channelizer drum 10 is moved in the direction of the arrow A1. After the portion of the locking lip 119 has contacted the inner surface 121, an opposing portion of the circumferential corner portion 78 is moved in the direction of the arrow A2. The circumferential locking lip 114 is then forced over the corresponding portion of the locking lip 119 to thereby generate a secure mechanical fit between the tire-lock channelizer drum 10 and the unitary stabilizing base 111.

Once the tire-lock channelizer drum 10 is secured to the unitary stabilizing base 111, the unitary stabilizing base 111 can serve as a ballasting device to prevent the tire-lock channelizer drum 10 from moving or tipping over. The unitary stabilizing base 111 comprises a relatively large surface area and a low profile for preventing the tire-lock channelizer drum 10 from walking or creeping on the horizontal supporting surface due to wind or vacuum caused by passing vehicles.

FIG. 5 illustrates the tire-lock channelizer drum 10 secured to the unitary stabilizing base 111. The tire-lock channelizer drum 10 can be attached and removed from the unitary stabilizing base 111 with relative ease. The unitary stabilizing base 111 does not need to be lifted up and above the tire-lock channelizer drum 10 for attachment or removal and, instead, a simple pivoting action can be used for securing the circumferential locking lip 114 of the tire-lock channelizer drum 10 to the locking lip 119 of the unitary stabilizing base 111. The design of the overmolded portion 112, including the locking lip 119, permits the tire-lock channelizer drum 10 to be easily snap connected to the base 111. Upon impact by a vehicle, the design of FIGS. 4 and 5 allows the tire-lock channelizer drum 10 to easily and cleanly separate from the base 111.

Although an exemplary embodiment of the invention has been shown and described, many other changes, modifications and substitutions, in addition to those set forth in the above paragraphs, may be made by one having ordinary skill in the art without necessarily departing from the spirit and scope of this invention.

What is claimed is:

1. A traffic channelizing device comprising a base portion which is adapted for insertion into a ballasting device, said base portion comprising:

a lower insertion end;

a tapering-diameter section extending upwardly from the lower insertion end, the tapering-diameter section increasing in diameter with distance from the lower insertion end;

an annular rib formed on an upper end of the tapering-diameter section; and a substantially constant-diameter section extending upwardly from the annular rib, a diameter of the substantially constant-diameter section being less than a diameter of the annular rib.

2. The traffic channelizing device as recited in claim 1, the tapering-diameter section further comprising:

a lower portion having a diameter which is slightly less than a diameter of an inner perimeter of the ballasting device, the inner perimeter forming an opening in the ballasting device; and the diameter of the annular rib being slightly greater than a diameter of the opening of the ballasting device, both the lower portion of the tapering-diameter section and the annular rib being adapted for being inserted through the opening of the ballasting device.

3. The traffic channelizing device as recited in claim 2, and the substantially constant-diameter section being adapted for contacting and fitting snugly within the inner perimeter of the ballasting device, and for applying a radially-outwardly directed force onto the inner perimeter of the ballasting device.

4. The traffic channelizing device as recited in claim 2, and further comprising:

a second annular rib formed at an upper end of the substantially constant-diameter section; and a second substantially constant-diameter section extending upwardly from the second annular rib, a diameter of the substantially constant-diameter section being less than a diameter of the second annular rib.

5. The base as recited in claim 4, and further comprising:

a third annular rib formed at an upper end of the second substantially constant-diameter section.

6. A traffic channelizer device, comprising:

an upper end;

a lower end adapted for being inserted into and fitting snugly within a perimeter of an opening of a ballasting device, the lower end being adapted for applying a radially-outwardly directed force onto the perimeter of the ballasting device;

an intermediate section disposed between the upper end and the lower end, the intermediate section having an intermediate-section diameter, which is greater than a diameter of the lower end, and a circumferential locking lip disposed around said lower end, the circumferential locking lip extending radially inwardly for a predetermined distance and being adapted for fitting around a locking lip of a unitary stabilizing base, to thereby secure the channelizer device to the unitary stabilizing base.

7. The traffic channelizer device as recited in claim 6, the intermediate section comprising a foot ring.

8. A traffic channelizer drum, comprising:

an upper end;

an intermediate section; and a lower end disposed adjacent to the intermediate section and having a reduced diameter relative to a diameter of the intermediate section, the lower end being adapted for being inserted into a tire ring, and the intermediate section being adapted for fitting snugly about an inner opening of the tire ring.

9. The traffic channelizer drum as recited in claim 8, the lower end being disposed below the intermediate section and comprising a circular edge.

10. A base for use with a traffic channelizer device, comprising:

an upper section comprising an annular rib; and a lower section having a reduced diameter, relative to a diameter of the annular rib, the lower section being sized and configured to be inserted into a tire ring and the annular rib being sized and configured to fit snugly within an opening of the tire ring.

11. The base as recited in claim 10, the diameter of the annular rib tapering into the reduced diameter of the lower section.

12. The base as recited in claim 11, the upper section further comprising a reduced diameter portion, disposed above the annular rib, the diameter of the annular rib tapering into a diameter of the reduced diameter portion.

13. The base as recited in claim 12, the annular rib comprising a foot ring.

14. The base as recited in claim 12, the annular rib comprising a retaining rib, which is adapted for applying an upward pressure onto the tire ring, to thereby prevent the tire ring from sliding off of the base when the lower section is secured within the tire ring.

15. The base as recited in claim 14, the upper section further comprising a second annular rib disposed above the reduced diameter portion.

16. The base as recited in claim 15, a diameter of the second annular rib tapering into the diameter of the reduced diameter portion.

17. The base as recited in claim 16, the upper section further comprising a second reduced diameter portion, disposed above the second annular rib, the diameter of the second annular rib tapering into a diameter of the second reduced diameter portion.

18. The base as recited in claim 17, a diameter of the second annular rib gradually tapering into the reduced diameter of the reduced diameter portion, and the diameter of the second annular rib quickly tapering into the diameter of the second reduced diameter portion.

19. The base as recited in claim 18, the second annular rib comprising a foot ring.

20. The base as recited in claim 18, the second annular rib comprising a second retaining rib, which is adapted for applying an upward pressure onto a second tire ring, to thereby prevent the second tire ring from sliding off of the base when the lower section is inserted into the tire ring.

21. The base as recited in claim 20, the upper section further comprising a third annular rib disposed above the second reduced diameter portion.

22. The base as recited in claim 21, the third annular rib having a diameter which is greater than the diameters of both the first annular rib and the second annular rib.

23. The base as recited in claim 22, the third annular rib comprising a foot ring.

24. The base as recited in claim 22, the diameter of the reduced-diameter annular channel being slightly greater than the diameter of an opening in a tire ring, the base further comprising:

a first annular rib disposed above the reduced-diameter annular channel; and a second annular rib disposed below the reduced-diameter annular channel.

25. A traffic channelizer drum having a circular bottom end that is sized and configured for being inserted from above into a tire ring, while the tire ring is resting on a support surface, and for contacting and fitting snugly around a circumferential opening of the tire ring.

26. The traffic channelizer drum as recited in claim 25, further comprising at least one foot ring adapted for receiving a downward force from a foot of a user, to thereby facilitate placement of the circular bottom end into the circumferential opening of the tire ring.

27. A method of inserting a traffic channelizer drum into a tire ring, comprising the following steps:

placing a traffic channelizer drum over a stationary tire ring;

aligning a generally circular bottom end of the traffic channelizer drum with a generally circular opening of the tire ring; and inserting the generally circular bottom end of the traffic channelizer drum into the generally circular opening of the tire ring, to thereby snugly fit the generally circular bottom end of the traffic channelizer drum into the generally circular opening of the tire ring.

28. The method as recited in claim 27, the inserting step comprising a step of applying an approximately downward pressure onto the traffic channelizer drum.

29. The method as recited in claim 28, the step of applying an approximately downward pressure onto the traffic channelizer drum comprising a step of applying an approximately downward pressure onto at least one foot step of the traffic channelizer drum.

30. The method as recited in claim 27, the inserting ring being performed on the tire ring, while the tire ring is resting on a support surface, and resulting in a frictional fit between the circular bottom end of the traffic channelizer drum and the circular opening of the tire ring.

* * * * *